US010886640B2

(12) United States Patent
Zhang et al.

(10) Patent No.: US 10,886,640 B2
(45) Date of Patent: Jan. 5, 2021

(54) CONDUCTIVE TERMINAL AND ELECTRICAL CONNECTOR

(71) Applicant: Tyco Electronics (Shanghai) Co. Ltd., Shanghai (CN)

(72) Inventors: Wei Zhang, Shanghai (CN); Ming Shi, Shanghai (CN); Xiaozhi Fu, Shanghai (CN); Dingbing Fan, Shanghai (CN); Hongtao Jiang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/285,326

(22) Filed: Feb. 26, 2019

(65) Prior Publication Data

US 2019/0267725 A1 Aug. 29, 2019

(30) Foreign Application Priority Data

Feb. 26, 2018 (CN) ..... 2018 1 0160341

(51) Int. Cl.

| | |
|---|---|
| ***H01R 4/28*** | (2006.01) |
| ***H01R 4/48*** | (2006.01) |
| ***H01R 13/432*** | (2006.01) |
| ***H01R 13/26*** | (2006.01) |

(52) U.S. Cl.

CPC ..... *H01R 4/28* (2013.01); *H01R 4/4818* (2013.01); *H01R 13/26* (2013.01); *H01R 13/432* (2013.01)

(58) Field of Classification Search

CPC ..... H01R 24/20; H01R 13/639
USPC ..... 439/733.1, 440, 441, 834
See application file for complete search history.

(56) References Cited

U.S. PATENT DOCUMENTS

| | | | | |
|---|---|---|---|---|
| 9,780,488 | B2 * | 10/2017 | Fu | H01R 12/515 |
| 2015/0255923 | A1 * | 9/2015 | Xu | H01R 4/4836 439/345 |
| 2018/0351290 | A1 * | 12/2018 | Shi | H01R 13/42 |
| 2019/0267725 | A1 * | 8/2019 | Zhang | H01R 13/432 |

* cited by examiner

*Primary Examiner* — Abdullah A Riyami
*Assistant Examiner* — Nader J Alhawamdeh
(74) *Attorney, Agent, or Firm* — Barley Snyder

(57) ABSTRACT

An electrical connector comprises a housing having a receiving passage and a conductive terminal inserted and removably mounted in the receiving passage in an insertion direction. The conductive terminal includes a body portion having a first end and a second end opposite to the first end, a clamping portion disposed at the first end of the body portion and configured to clamp a wire of a cable, and a spring locking portion disposed on the body portion and obliquely extending from the body portion in a direction away from the body portion toward the second end. The locking portion is configured to engage a bottom wall of the receiving passage. The engagement of the locking portion with the bottom wall of the receiving passage is released by driving the locking portion with an external tool inserted in the insertion direction.

22 Claims, 7 Drawing Sheets

CONDUCTIVE TERMINAL AND ELECTRICAL CONNECTOR

CROSS-REFERENCE TO RELATED APPLICATION

This application claims the benefit of the filing date under 35 U.S.C. § 119(a)-(d) of Chinese Patent Application No. 201810160341.3, filed on Feb. 26, 2018.

FIELD OF THE INVENTION

The present invention relates to an electrical connector and, more particularly, to an electrical connector having a conductive terminal removably mounted in a housing.

BACKGROUND

Cables are typically connected to a plug connector and a receptacle connector, respectively, to facilitate electrical connection of the cables, which is achieved by mutual cooperation between the plug connector and the socket connector. In some cases, a connector is used to connect a cable to a printed circuit board.

The electrical connector generally includes an insulative housing and a plurality of conductive terminals disposed within the housing. When connecting two cables by the plug connector and the socket connector mating with each other, insulating layers of the two cables are stripped off to expose wires, and the wires are then inserted into the plug connector and the socket connector and electrically connected to conductive terminals held in the respective housings. Electrical connection between the two cables is achieved through the electrical connection of the conductive terminal in the socket connector with the conductive terminal in the plug connector.

In existing electrical connectors, after insertion into the plug connector or receptacle connector, the conductive terminals cannot be removed therefrom. When something is wrong with the conductive terminals, for example, poor contact between the conductive terminal and the wire or with the mating conductive terminals, or excessive wear of the conductive terminals, conductivity becomes poor. The entire plug connector or socket connector, rather than only the conductive terminals, therefore must to be replaced, which reduces work efficiency and greatly increases cost of the plug connector and socket connector.

SUMMARY

An electrical connector comprises a housing having a receiving passage and a conductive terminal inserted and removably mounted in the receiving passage in an insertion direction. The conductive terminal includes a body portion having a first end and a second end opposite to the first end, a clamping portion disposed at the first end of the body portion and configured to clamp a wire of a cable, and a spring locking portion disposed on the body portion and obliquely extending from the body portion in a direction away from the body portion toward the second end. The locking portion is configured to engage a bottom wall of the receiving passage. The engagement of the locking portion with the bottom wall of the receiving passage is released by driving the locking portion with an external tool inserted in the insertion direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
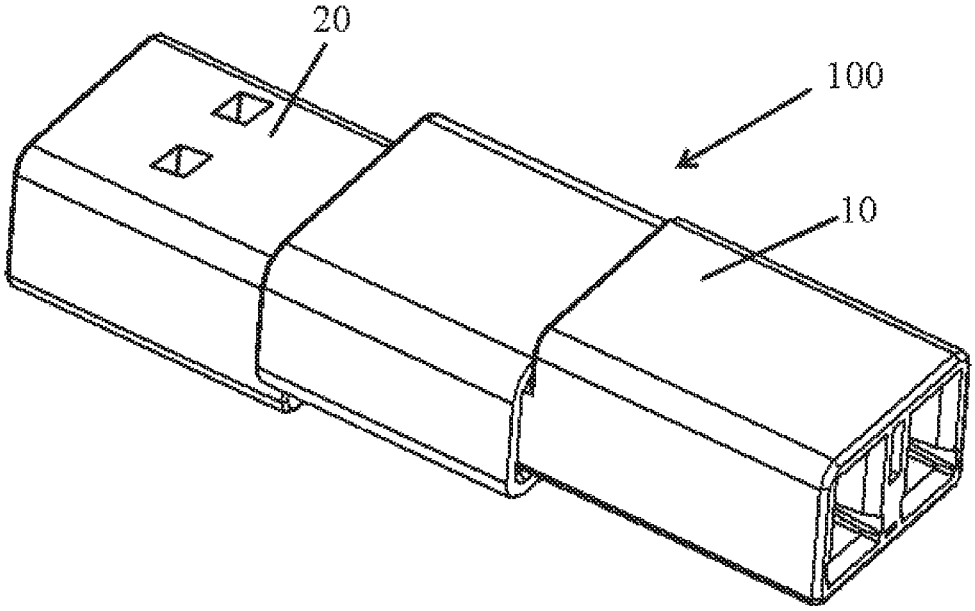
FIG. 1 is a perspective view of a connector assembly according to an embodiment.

The present disclosure will be specifically described below by way of embodiments and with reference to the accompanying drawings. In the specification, the same or similar reference numerals indicate the same or similar components. The description of the embodiments of the present disclosure with reference to Figures is intended to be illustrative of the overall inventive concept of the present disclosure and is not to be construed as limiting the present disclosure.

In addition, in the following detailed description, numerous specific details are set forth to facilitate explanation so as to provide a comprehensive understanding of embodiments of the disclosure. Obviously, however, one or more embodiments may be practiced without these specific details. In other instances, well-known structures and devices are shown in form of charts so as to simplify Figures.

Figure 2:
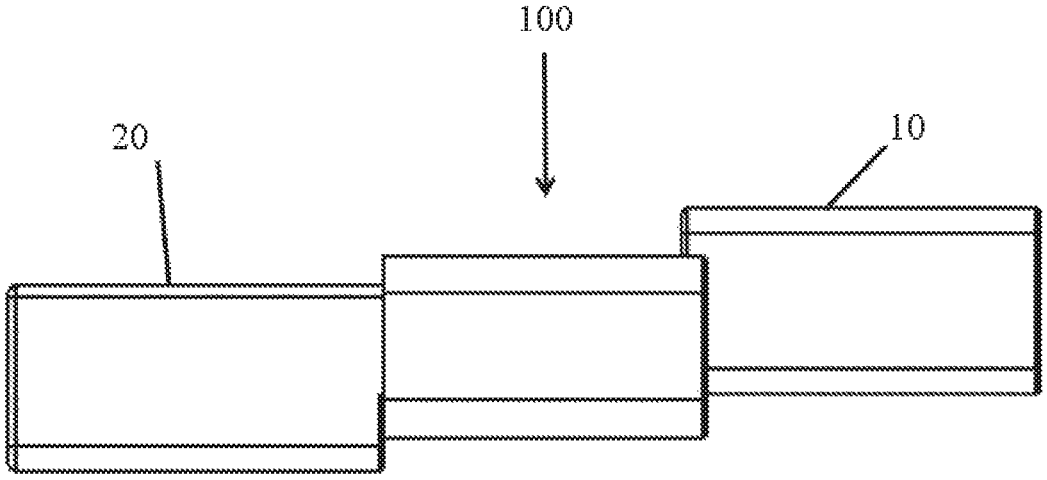
FIG. 2 is a side view of the connector assembly.
Figure 3:
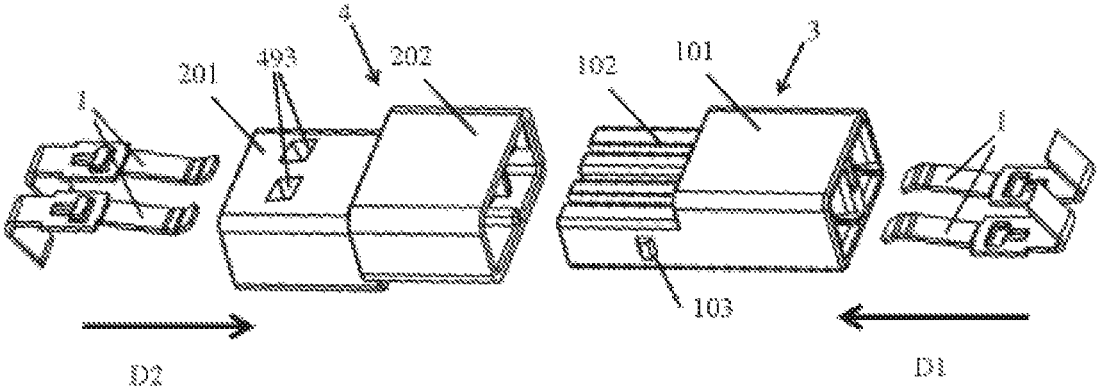
FIG. 3 is an exploded perspective view of the connector assembly.

A connector assembly 100 according to an embodiment, as shown in FIGS. 1-3, comprises an electrical connector 10 and a mating connector 20 matable with the electrical connector 10. Each of the electrical connector 10 and the mating connector 20 may be electrically connected to external cables and mated to electrically connect the external cables. In the shown embodiment, the electrical connector 10 is a plug connector and the mating connector 20 is a socket connector. In other embodiments, the electrical connector 10 may be the socket connector and the mating connector 20 may be the plug connector; the electrical connector 10 is one of the socket connector and the plug connector, and the mating connector 20 is the other of the socket connector and the plug connector.

Figure 6:
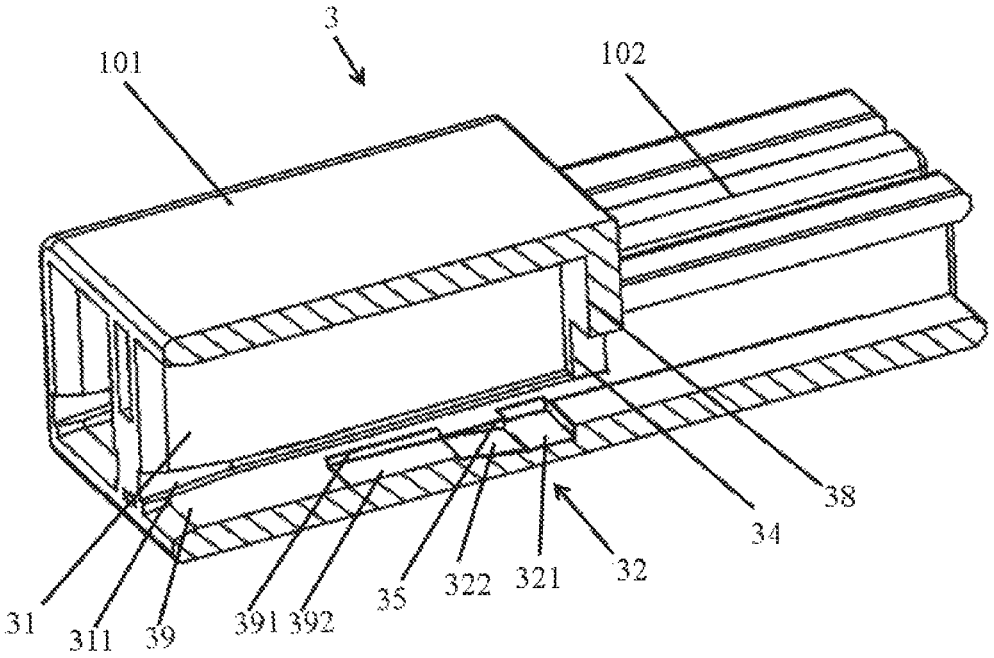
FIG. 6 is a sectional perspective view of a housing of a plug connector of the connector assembly.
Figure 8:
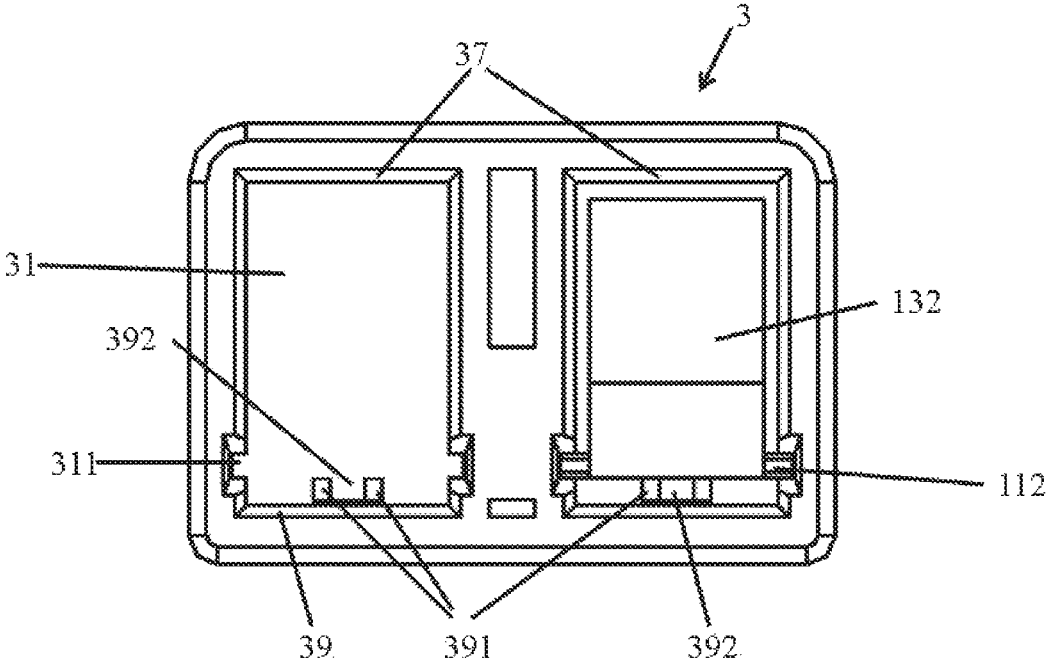
FIG. 8 is a left end view of the plug connector.

The electrical connector 10, as shown in FIGS. 1-5, comprises a housing 3 and at least one electrically conductive terminal 1 mounted in the housing 3. As shown in FIGS. 6 and 8, at least one receiving passage 31 is formed in the housing 3, and the receiving passage 31 has a first portion located in a first base 101 of the housing 3 and a second portion located in a plug portion 102 of the housing 3. The housing 3 includes two receiving passages 31 in the shown embodiment, however, the housing 3 may include other numbers of receiving passages 31 in other embodiments. The conductive terminals 1 are respectively inserted and mounted in the two receiving passages 31 of the electrical connector 10 in an insertion direction D1.

Figure 4:
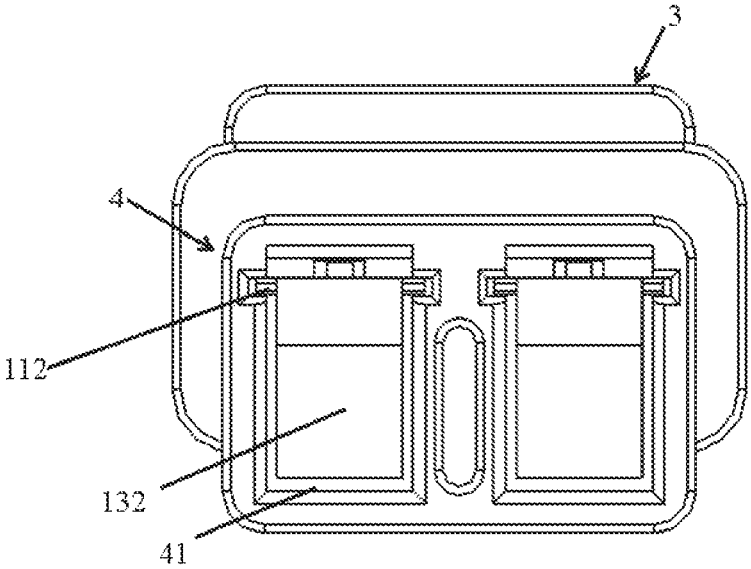
FIG. 4 is a left end view of the connector assembly.
Figure 5:
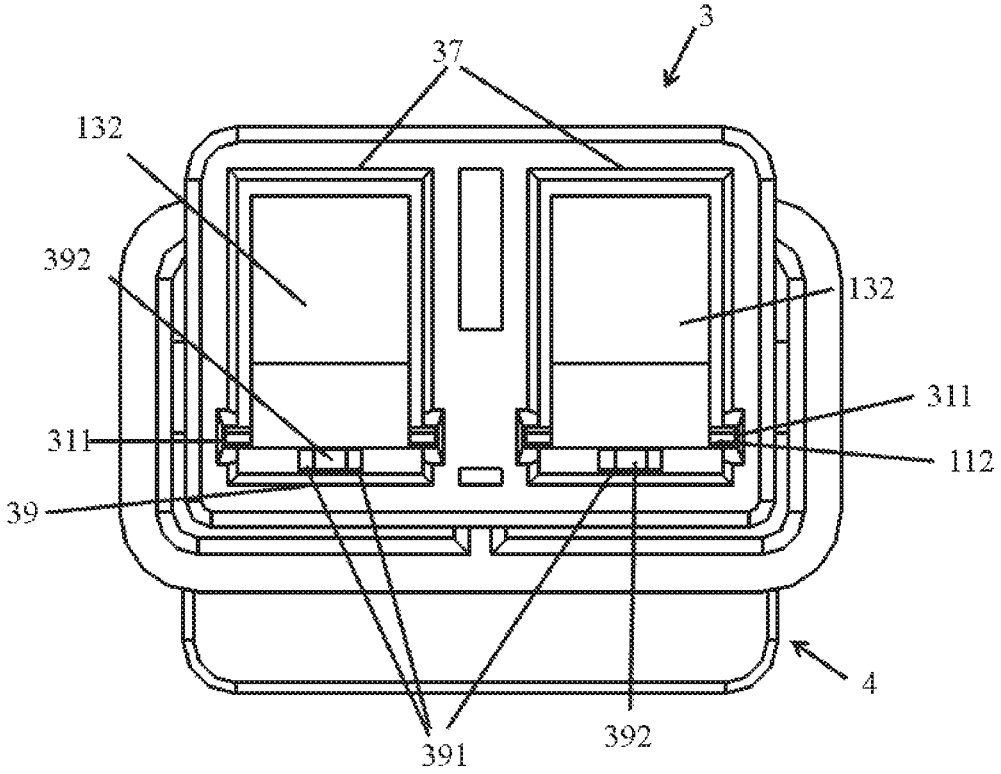
FIG. 5 is a right end view of the connector assembly.

The mating connector 20, as shown in FIGS. 3 and 4, includes a housing 4 having a receiving passage 41 with a first portion disposed in a second base 201 of the housing 4 and a second portion disposed in a socket portion 202 of the housing 4. In the shown embodiment, the housing 4 has two receiving passages 41, but may include other numbers of receiving passages 41 in other embodiments. The conductive terminals 1 are respectively inserted and mounted in the two insertion passages 41 of the mating connector 20 in an insertion direction D2. The structure of the receiving passage 41 is the same as that of the receiving passage 31. For the sake of brevity, the following description will be made by taking the receiving passage 31 as an example; should be understood that the internal structure of the receiving passage 31 is also suitable for receiving the passage 41.

Figure 7:
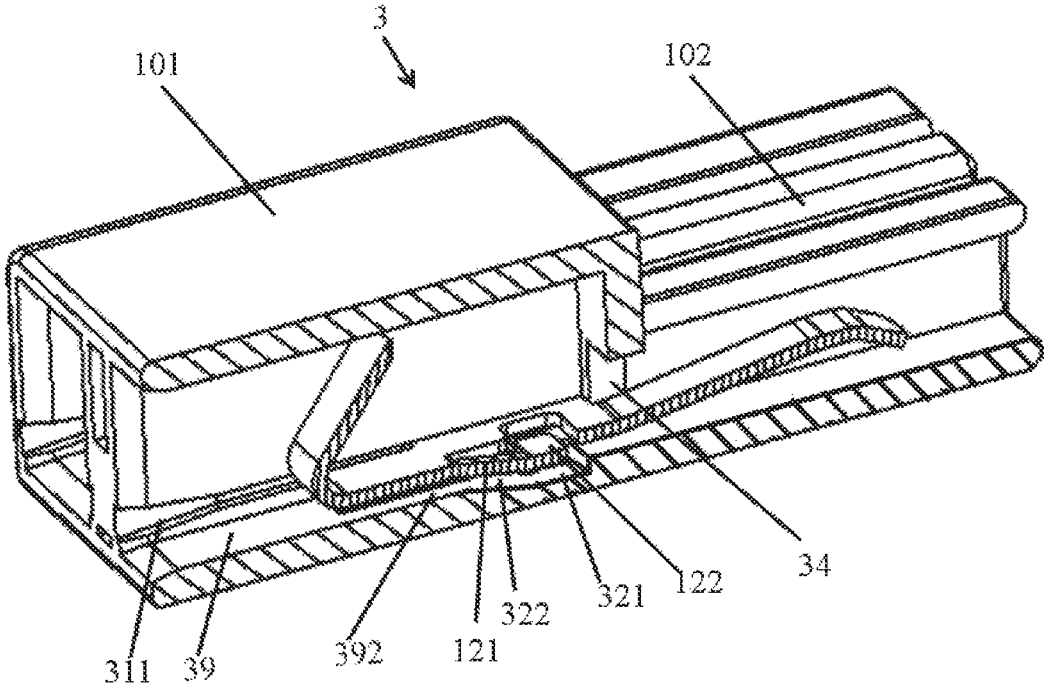
FIG. 7 is a sectional perspective view of a conductive terminal in the housing.
Figure 10:
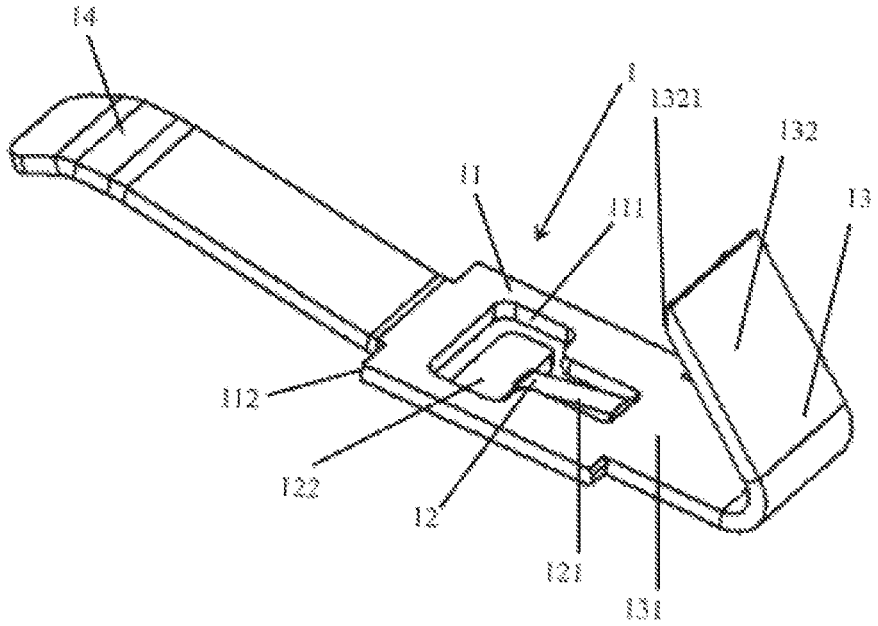
FIG. 10 is a top perspective view of the conductive terminal.
Figure 11:
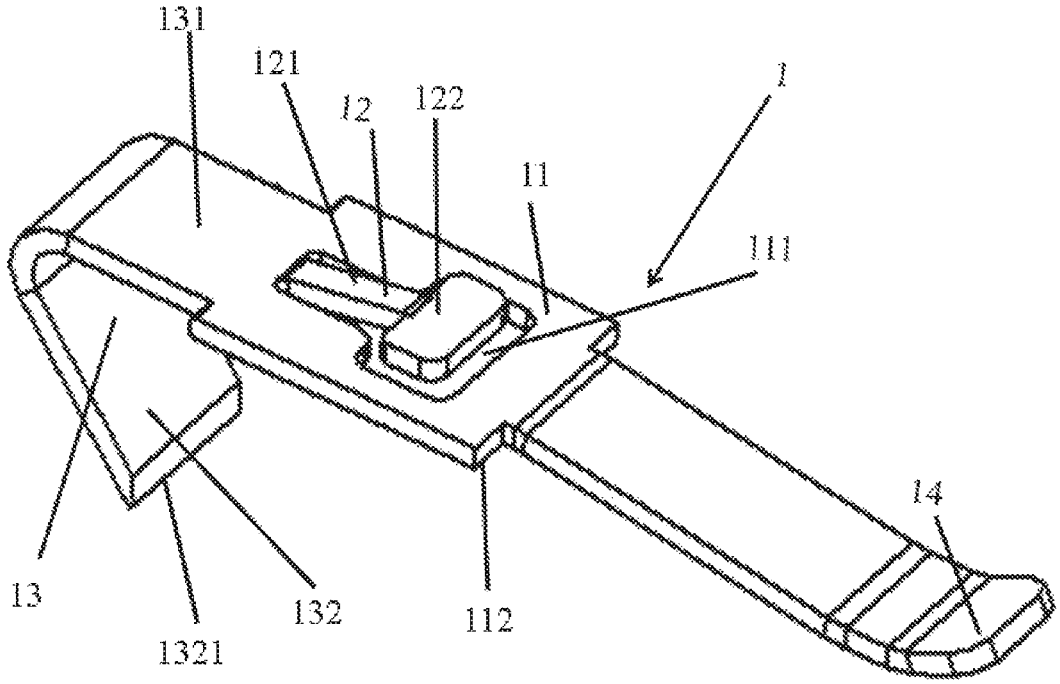
FIG. 11 is a bottom perspective view of the conductive terminal.

As shown in FIG. 3, the conductive terminal 1 is inserted into the receiving passage 31 of the electrical connector 10 in the insertion direction D1 and the receiving passage 41 of the mating connector 20 in the insertion direction D2. As shown in FIGS. 7, 10, and 11, the conductive terminal 1 includes a flat body portion 11 having a first end and a second end opposite to the first end, a clamping portion 13 disposed at the first end of the body portion 11, and a spring locking portion 12 disposed on the body portion 11 between the first end and the second end. The conductive terminal 1 is made of a metal material, for example, copper. The clamping portion 13 cooperates with a top wall 37 of the receiving passage 31 of the electrical connector 10 so as to clamp a wire of the cable. The spring locking portion 12 extends obliquely from the body portion 11 in a direction away from the body portion 11 toward the second end and engages a bottom wall 39 of the receiving passage 31. The locking portion 12 is driven by an external tool, such as a screwdriver, inserted in the insertion direction D1, D2 to release the locking portion 12 from the bottom wall 39 of the receiving passage 31, so that the conductive terminal 1 is removably mounted in the receiving passage 31.

The housing 3, as shown in FIGS. 6 and 7, includes at least one locking recess 32 that is formed in the bottom wall 39 of the receiving passage 31. The locking recess 32 is configured to at least partially receive the locking portion 12 of the conductive terminal 1 when the conductive terminal 1 is inserted into the receiving passage 31 so as to prevent the conductive terminal 1 from being released from the receiving passage 31 in a direction opposite to the insertion direction D1.

The locking portion 12, as shown in FIGS. 10 and 11, includes a connecting arm 121 extending obliquely from the body portion 11 in a direction away from the body portion 11 toward the second end and a locking head 122 protruding from at least one of two sides of a free end of the connecting arm 121 in a direction perpendicular to the insertion direction D1. The locking recess 32 comprises a recess 321, as shown in FIGS. 6 and 7, formed by recessing downward from the bottom wall 39 of the receiving passage 31 and a ramp 322 that slopes downward from the bottom wall 39 of the receiving passage 31. The ramp 322 communicates with the recess 321 such that when the conductive terminal 1 is inserted into the receiving passage 31 and the locking head 122 is moved to be above the locking recess 32, the locking head 122 is pressed and contained in the recess 321 by the connecting arm 121, and the connecting arm 121 is received and supported by the ramp 322. The ramp 322 is inclined downward with respect to the bottom wall 39 and communicates with the recess 321, and two blocking steps 35 are formed at an upstream side of the recess 321 in the insertion direction D1 and at both sides of the ramp 322. The two blocking steps 35 abut against the locking head 122 located in the recess 321 when the locking head 122 is pressed into the recess 321 by the connecting arm 121 so as to prevent the conductive terminal 1 from being moved in the direction opposite to the insertion direction D1 and being released from the locking recess 32.

The housing 3, as shown in FIGS. 5-8, has a guiding passage 392 disposed in the receiving passage 31 and extending in the insertion direction D1. The guiding passage 392 guides the external tool inserted in the insertion direction D1 to drive the connecting arm 121 of the locking portion 12, so that the locking head 122 is released from the locking recess 32. In an embodiment, the guiding passage 392 is defined by two guiding protrusions 391, each of which protrudes from the bottom wall 39 of the receiving passage 31 and extends in the insertion direction D1. The guiding passage 392 communicates with the ramp 322 to guide the external tool to drive the connecting arm 121, so that the locking head 122 is released from the locking recess 32, and then the conductive terminal 1 may be pulled out of the housing 3 in the direction opposite to the insertion direction D1. The guiding of the external tool in the insertion direction D1 in the receiving passage 31 reduces electric leakage of the electrical connector 10 and prevents dust from entering into the receiving passage 31. In an alternative embodiment, the guiding passage 392 is formed as a recess portion extending in the insertion direction D1 in the bottom wall 39 of the receiving passage 31.

Figure 12:
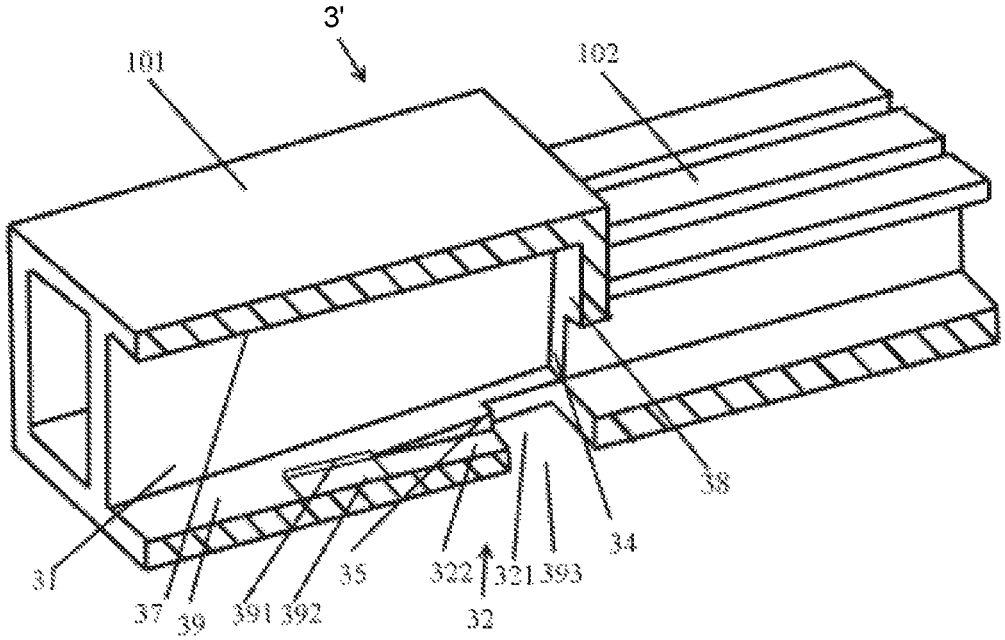
FIG. 12 is a sectional perspective view of a housing of the plug connector according to another embodiment.
Figure 13:
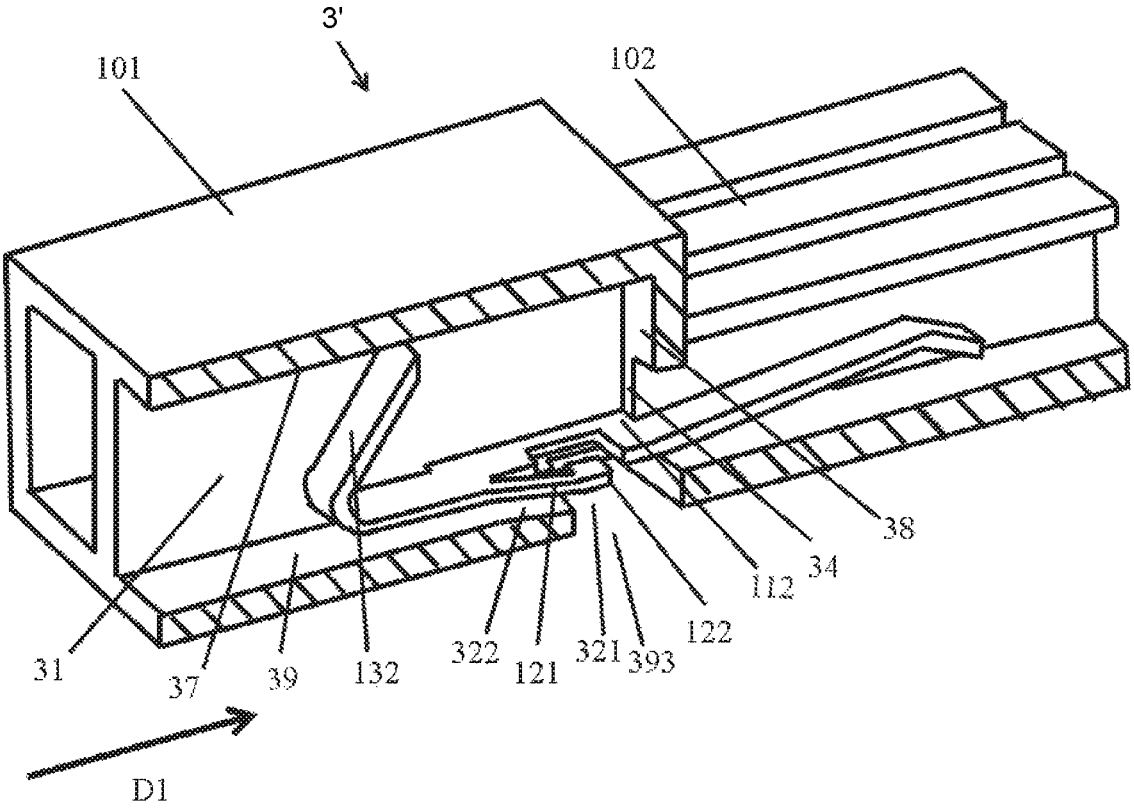
FIG. 13 is a sectional perspective view of the conductive terminal in the housing of FIG. 12.

A housing 3' for the electrical connector 10 according to another embodiment is shown in FIGS. 12 and 13. The housing 3' is identical to the housing 3 except that the housing 3' includes a release hole 393. The release hole 393 is formed in the bottom wall 39 of the receiving passage 31 and extends in a direction perpendicular to the insertion direction D1 so as to guide the external tool to drive the locking portion 12 contained in the recess 321. More specifically, under the driving of the external tool, the locking head 122 is released from the locking recess 32, and then the conductive terminal 1 may be pulled out of the housing 3 in the direction opposite to the insertion direction D1. In the shown embodiment, a cross-sectional area of the release hole 393 is equal to a cross-sectional area of the recess 321. In other embodiments, the cross-sectional area of the release hole 393 may be smaller than the cross-sectional area of the recess 321, as long as the external tool can pass through the release hole 393 and drive the locking portion 12 out of the locking recess 32.

As shown in FIGS. 10 and 11, the body portion 11 of the conductive terminal 1 has an unlocking opening 111 shaped to accommodate the locking portion 12. The connecting arm 121 is elastic and is capable of pressing the locking head 122 in a direction away from the body portion 11, and when the locking head 122 or the connecting arm 121 is subjected to an external force applied by the external tool, the connecting arm 121 and the locking head 122 is driven to move toward and approach the body portion 11, and even pass through the unlocking opening 111, unlocking the locking portion 12 to remove the conductive terminal 1 from the housing 3. The locking head 122 is rectangular in the shown embodiment, however, in other embodiments, the locking head 122 may be configured as any suitable shape, such as circular, triangular or even other irregular shapes.

The body portion 11, as shown in FIGS. 10 and 11, has a shoulder 112 extending in the direction perpendicular to the insertion direction D1. The shoulder 112 engages a sidewall of the receiving passage 31 so as to prevent the conductive terminal 1 from moving further in the receiving passage 31 in the insertion direction D1, facilitating fixing of the conductive terminal 1. A contact portion 14 is disposed at the second end of the body portion 11 and is configured to be in electrical contact with the contact portion of the conductive terminal 1 in the mating connector 20. The shoulder 112 of the conductive terminal 1 abuts against two terminal blocking protrusions 34 formed on the side wall of the receiving passage 31 while the locking head 122 is received in the recess 321, preventing the conductive terminal 1 from moving further in the insertion direction D1 in the receiving passage 31.

Figure 14:
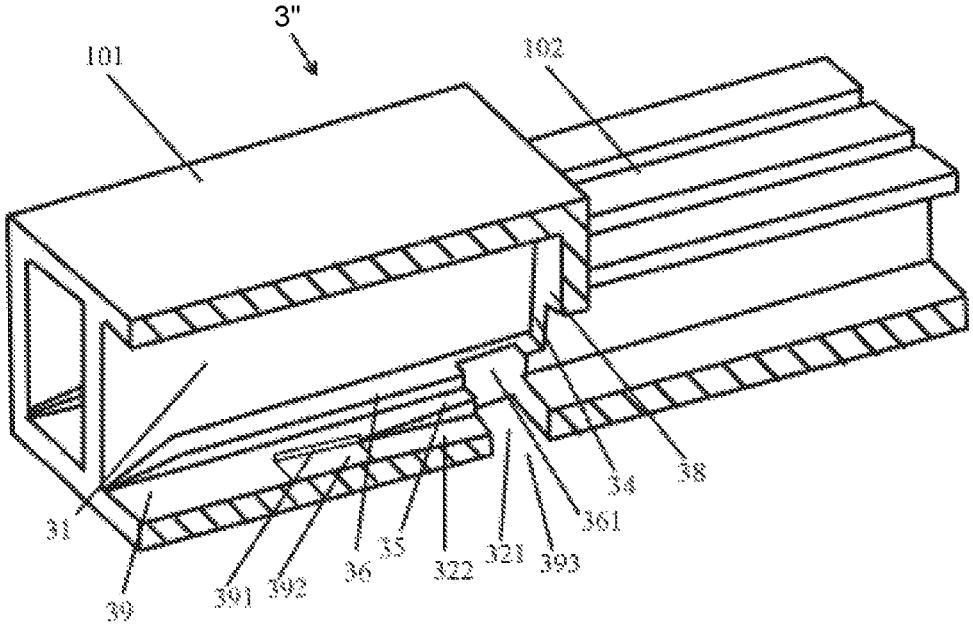
FIG. 14 is a sectional perspective view of a housing of the plug connector according to another embodiment.

A housing 3" of the electrical connector 10 according to another embodiment is shown in FIG. 14. In the housing 3", a support step 36 is formed in the receiving passage 31. The lock portion 12 is released through the release hole 393 and/or the guiding passage 392. The other structure of the receiving passage 31 of the housing 3" is the same as the housing 3.

In the housing 3" shown in FIG. 14, a pair of support steps 36 extend along two side walls of the receiving passage 31 and terminate at the terminal blocking protrusions 34 so as to movably support two sides of the body portion 11 and the locking portion 122 on the two support steps 36. When the conductive terminal 1 is inserted into the receiving passage 31, the body portion 11 and the locking head portion 122 are not in contact with the bottom wall 39, but are supported by the support steps 36 to move along the support steps 36. A gap is formed between the body portion 11, as well as the lock head 122, with respect to the bottom wall 39. In an embodiment, a notch 361 is formed at a portion of the support step 36 above the locking recess 32, a cross-sectional shape of the notch 361 is identical to that of the locking recess 32, so that when moving to be above the locking recess 32, the locking head 122 is not supported by the support step 36 but pressed into the locking recess 32 by the connecting arm 121. The cross sectional shape of the notch 361 does not necessarily correspond with that of the locking recess 32 as long as the locking head 122 tends to be pressed into the locking recess 32 by the connecting arm 121 rather than being supported by the support step 36 when moving to be over the locking recess 32.

Because the conductive terminal 1 is raised by the support step 36 provided in the receiving passage 31, a contact portion 14 of the conductive terminal 1 is correspondingly raised in the plug portion 102 of the electrical connector 10. When the plug portion 102 is inserted into the socket portion 202 of the mating connector 20, the contact portion 14 of the conductive terminal 1 in the plug portion 102 is facilitated to make electrical contact with the contact portion of the mating conductive terminal in the socket portion 202.

As shown in FIGS. 6-8, the housing 3 comprises at least one pair of guiding grooves 311 respectively formed by recessing in the two side walls of the receiving passage 31 and terminating at the terminal blocking protrusions 34. The guiding grooves 311 guide movements of the two shoulders 112 of the conductive terminal 1. Only one guiding groove 311 is shown in the FIGS. 6 and 7. An inlet end of each of the guiding grooves 311 is formed with an expansion portion to guide the shoulder 112 into the guiding groove 311.

As shown in FIGS. 10 and 11, the clamping portion 13 of the conductive terminal 1 includes a support arm 131 extending from the first end of the body portion 11 and a clamping arm 132 extending from a free end of the support arm 131 and bent at an acute angle toward the second end of the body portion 11 relative to the support arm 131. The clamping arm 132 cooperates with a top wall 37 of the receiving passage 31 of the electrical connector 10 to clamp the wire of the cable. In this way, the wire is prevented from being released from the receiving passage 31 in the direction opposite to the insertion direction D1. In order to increase the clamping force for the wire and enhance the electrical connection of the conductive terminal 1 to the wire, the free end 1321 of the clamping arm 132 has a blade such that the free end 1321 may penetrate into the wire.

The housing 3, as shown in FIG. 6, comprises a cable blocking wall 38 formed in the receiving passage 31 and configured to prevent further movement of the wire of the cable inserted into the housing 3 in the insertion direction D1. The cable blocking wall 38 is integrally formed with the terminal blocking protrusion 34, and the cable blocking wall 38 extends downward from the top wall 37 of the housing 3 in the direction perpendicular to the top wall 37.

Figure 9:
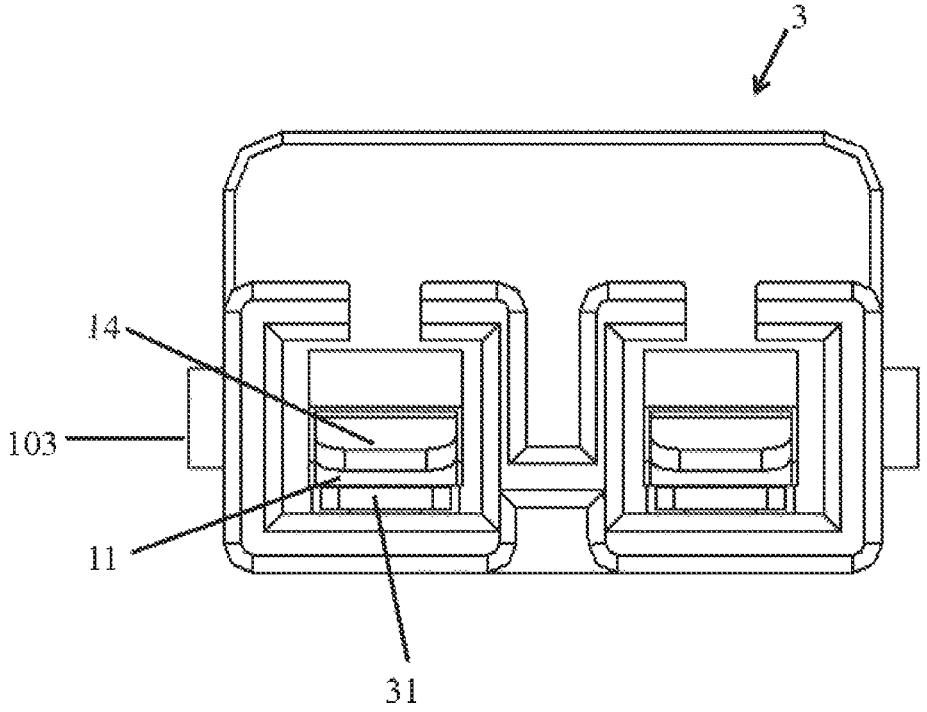
FIG. 9 is a right end view of the plug connector.

As shown in FIGS. 8 and 9, a lower edge of the guiding groove 311 is flush with a top of the guiding protrusion 391 or on the same level, and when the shoulder 112 is guided by the guiding groove 311, the body portion 11 is supported by the guiding protrusion 391. In other embodiments, the lower edge of the guiding groove 311 and the top of the guiding protrusion 391 may also be not flush with each other or at the same level.

The housing 3 of the electrical connector 10 at least partially engages the housing 4 of the mating connector 20. When the conductive terminal 1 is locked in the receiving passage 31, the body portion 11 and the clamping portion 13 of the conductive terminal 1 are received in the first portion of the receiving passage 31 of the electrical connector 10 located in the first base 101, and the contact portion 14 of the conductive terminal 1 is received in the second portion of the receiving passage 31 of the electrical connector 10 located in the plug portion 102. Similarly, when the mating conductive terminal 1 is locked in the housing 4 of the mating connector 20, the body portion 11 and the clamping portion 13 of the mating conductive terminal 1 are received in the first portion of the receiving passage 41 of the mating connector 20 located in the second base 201, and the contact portion 14 of the mating conductive terminal 1 is received in the second portion of the receiving passage 41 of the mating connector 20 in the socket portion 202. When the plug portion 102 is inserted into the socket portion 202, the contact portion 14 of the mating conductive terminal 1 of the mating connector 20 is inserted into the receiving passage 31 of the electrical connector 10 to make electrical contact with the contact portion 14 of the conductive terminal 1 in the electrical connector 10.

In order to facilitate the connection between the housing 3 of the electrical connector 10 and the housing 4 of the mating connector 20, at least one projection 103 is provided on an outer side of the plug portion 102, as shown in FIGS. 3 and 9. At least one groove engaging projection 103 is provided in an inner side of the socket portion 202. In other embodiments, the groove may be provided in the outer side of the plug portion 102, and the projection 103, engaged with the groove, is provided on the inner side of the socket portion 202.

As shown in FIG. 3, a release hole 493 having the same structure and function as the release hole 393 is provided in the second base 201 so as to allow the external tool to pass therethrough to remove the mating conductive terminal 1 from the housing 4.

What is claimed is:

1. An electrical connector, comprising:

a housing having a receiving passage; and a conductive terminal inserted and removably mounted in the receiving passage in an insertion direction, the conductive terminal including a body portion having a first end and a second end opposite to the first end, a clamping portion disposed at the first end of the body portion and configured to clamp a wire of a cable, and a spring locking portion disposed on the body portion and obliquely extending from the body portion in a direction away from the body portion toward the second end, the locking portion is configured to engage a bottom wall of the receiving passage and the engagement of the locking portion with the bottom wall of the receiving passage is released by driving the locking portion with an external tool inserted in the insertion direction.

2. The electrical connector of claim 1, wherein the housing includes a locking recess formed in the bottom wall and configured to at least partially receive the spring locking portion when the conductive terminal is inserted into the receiving passage, the locking recess preventing the conductive terminal from being released from the receiving passage in a direction opposite to the insertion direction.

3. An electrical connector, comprising:

a housing having a receiving passage; and a conductive terminal inserted and removably mounted in the receiving passage in an insertion direction, the conductive terminal including a body portion having a first end and a second end opposite to the first end, a clamping portion disposed at the first end of the body portion and configured to clamp a wire of a cable, and a spring locking portion disposed on the body portion and including a connecting arm extending obliquely from the body portion in a direction away from the body portion toward the second end and a locking head protruding from a side of a free end of the connecting arm in a direction perpendicular to the insertion direction, the locking portion configured to engage a locking recess formed in a bottom wall of the receiving passage, the locking recess configured to at least partially receive the spring locking portion when the conductive terminal is inserted into the receiving passage, the locking recess preventing the conductive terminal from being released from the receiving passage in a direction opposite to the insertion direction, wherein the engagement of the locking portion with the locking recess of the receiving passage is released by driving the locking portion with an external tool inserted in the insertion direction.

4. The electrical connector of claim 3, wherein the locking recess includes a recess formed by recessing downward from the bottom wall of the receiving passage and a ramp that slopes downward from the bottom wall of the receiving passage and communicates with the recess, the connecting arm is received in the ramp and the locking head is received in the recess when the conductive terminal is inserted into the receiving passage.

5. The electrical connector of claim 3, wherein the housing includes a blocking step formed at an upstream side of the recess in the insertion direction and at both sides of the ramp and abutting against the locking head located in the recess, the blocking step preventing the conductive terminal from moving in the direction opposite to the insertion direction.

6. The electrical connector of claim 2, wherein the housing has a guiding passage disposed in the receiving passage and extending in the insertion direction, the guiding passage arranged between the locking recess and an open end of the receiving passage into which the conductive terminal is received in the insertion direction, the guiding passage defining an opening between the bottom wall of the receiving passage and the conductive terminal and constructed to guide the external tool arranged in the opening to drive the spring locking portion to release from the locking recess.

7. The electrical connector of claim 6, wherein the guiding passage is defined by a pair of guiding protrusions each protruding from the bottom wall of the receiving passage and extending in the insertion direction.

8. The electrical connector of claim 7, wherein the guiding passage communicates with the ramp and the external tool is guided by the guiding passage to drive the connecting arm to release the locking portion from the locking recess.

9. The electrical connector of claim 6, wherein the housing has a release hole formed in the bottom wall of the receiving passage and extending in a direction perpendicular to the insertion direction, the release hole constructed to guide the external tool to drive the locking portion and release the locking portion from the locking recess.

10. The electrical connector of claim 1, wherein the body portion has a shoulder extending in a direction perpendicular to the insertion direction, the housing has a terminal blocking protrusion formed on a sidewall of the receiving passage, the shoulder of the conductive terminal abuts against the terminal blocking protrusion so as to prevent the conductive terminal from moving further in the receiving passage.

11. The electrical connector of claim 10, wherein the housing has a support step extending from and along the side wall of the receiving passage and terminating at the terminal blocking protrusion, the body portion and the locking portion are movably supported on the support step.

12. An electrical connector, comprising:

a housing having:

a receiving passage;

a terminal blocking protrusion formed in the receiving passage; and a pair of guiding grooves formed by recessing in side walls of the receiving passage and terminating at the terminal blocking protrusion; and a conductive terminal inserted and removably mounted in the receiving passage in an insertion direction, the conductive terminal including a body portion having:

a first end and a second end opposite to the first end;

a shoulder extending in a direction perpendicular to the insertion direction, the guiding grooves guiding movement of the shoulder, the shoulder abutting against the terminal blocking protrusion so as to prevent the conductive terminal from moving further in the receiving passage;

a clamping portion disposed at the first end of the body portion and configured to clamp a wire of a cable; and a spring locking portion disposed on the body portion and obliquely extending from the body portion in a direction away from the body portion toward the second end, the locking portion is configured to engage a bottom wall of the receiving passage and the engagement of the locking portion with the bottom wall of the receiving passage is released by driving the locking portion with an external tool inserted in the insertion direction.

13. The electrical connector of claim 12, wherein an inlet end of each of the guiding grooves has an expansion portion constructed to guide the shoulder into each of the guiding grooves.

14. The electrical connector of claim 1, wherein the clamping portion includes a support arm extending from the first end of the body portion and a clamping arm extending from the support arm and bent at an acute angle toward the second end of the body portion relative to the support arm, a free end of the clamping arm cooperates with a top wall of the receiving passage to clamp the wire of the cable between the free end of the clamping arm and the top wall of the receiving passage.

15. The electrical connector of claim 14, wherein the free end of the clamping arm has a blade.

16. The electrical connector of claim 1, wherein the housing has a cable blocking wall in the receiving passage configured to prevent further movement of the wire of the cable inserted into the housing in the insertion direction.

17. The electrical connector of claim 1, wherein the electrical connector is configured as one of a receptacle connector and a plug connector.

18. The electrical connector of claim 17, wherein a housing of the plug connector has a first base and a plug portion, a body portion and a clamping portion of a conductive terminal of the plug connector are received in a first portion of a receiving passage in the first base and a contact portion of the conductive terminal is received in a second portion of the receiving passage in the plug portion.

19. The electrical connector of claim 18, wherein a housing of the receptacle connector has a second base and a socket portion, a body portion and a clamping portion of a conductive terminal of the receptacle connector are received in a first portion of a receiving passage in the second base and a contact portion of the conductive terminal of the receptacle connector is received in a second portion of the receiving passage in the socket portion.

20. The electrical connector of claim 19, wherein the plug portion is adapted to be inserted into the socket portion such that the contact portion of the conductive terminal of the socket connector is inserted into the receiving passage of the plug connector and electrically connects with the contact portion of the conductive terminal of the plug connector.

21. The electrical connector of claim 20, wherein a projection is disposed on an outer side of one of the plug portion and the socket portion and a groove engaging the projection is disposed on an inner side of the other of the plug portion and the socket portion.

22. The electrical connector of claim 1, wherein the second end of the body portion has a contact portion.

* * * * *